US011076241B2

(12) United States Patent
Voloshchenko et al.

(10) Patent No.: US 11,076,241 B2
(45) Date of Patent: Jul. 27, 2021

(54) ELECTROACOUSTIC TRANSDUCER FOR THE PARAMETRIC GENERATION OF ULTRASOUND

(71) Applicant: OOO "GIDROMARINN", Moscow (RU)

(72) Inventors: Vadim Yu. Voloshchenko, Taganrog (RU); Sergey P. Tarasov, Taganrog (RU); Anton Yu. Pleshkov, Seversk Tomsk Obl. (RU); Vasiliy A. Voronin, Taganrog (RU); Petr P. Pivnev, Taganrog (RU); Aleksandr P. Voloshchenko, Taganrog (RU); Vladimir V. Grivtsov, Taganrog (RU)

(73) Assignee: OOO "GIDROMARINN", Moscow (RU)

( * ) Notice: Subject to any disclaimer, the term of this patent is extended or adjusted under 35 U.S.C. 154(b) by 0 days.

(21) Appl. No.: 16/914,215

(22) Filed: Jun. 26, 2020

(65) Prior Publication Data

US 2020/0396546 A1 Dec. 17, 2020

Related U.S. Application Data

(63) Continuation of application No. PCT/RU2018/000861, filed on Dec. 24, 2018.

(30) Foreign Application Priority Data

Dec. 28, 2017 (RU) ..... RU2017146766

(51) Int. Cl.
*H04R 17/00* (2006.01)
*H04R 17/10* (2006.01)

(52) U.S. Cl.
CPC ..... *H04R 17/10* (2013.01); *H04R 2217/03* (2013.01)

(58) Field of Classification Search
CPC ..... H04R 17/005; H04R 2217/03; B06B 1/0607; B06B 1/0611; G10K 11/32
See application file for complete search history.

(56) References Cited

U.S. PATENT DOCUMENTS 2,565,159 A * 8/1951 Williams ..... G10K 11/32 310/335
3,964,013 A 6/1976 Konard
(Continued)

FOREIGN PATENT DOCUMENTS

RU 2589247 C2 7/2016
SU 1260849 A1 9/1986
(Continued)

OTHER PUBLICATIONS

International Search Report from PCT/RU2018/000861, filed Dec. 24, 2018, dated Jun. 20, 2019.
(Continued)

*Primary Examiner* — Ryan Robinson
(74) *Attorney, Agent, or Firm* — Patentbar International P.C.

(57) ABSTRACT

The construction has two piezoelectric transducers with radiating apertures shaped as sections of spherical surface one is concave, the second is convex, of sufficient wave sizes $D/\lambda>10$, where D is the diameter of the aperture, $\lambda$ is the wavelength of the emitted pump signal). For each piezoelectric transducers radii of curvature $R_0$, focal lengths $F_0$ and focal spots radii $r_0$ with a wave length of radiated signal are the same and are related by $r_0 \times R_0 = \mathbf{0.61} \times \lambda \times F_0$. Piezoelectric transducers with radiating apertures shaped as sections of spherical surface are provided with shielding elements, hydro-, electric- and noise insulation and one of them
(Continued)

with convex aperture is made with an open axial hole with radius $r=(2\div3)\times r_0$ in the central part of the convex spherical surface of the aperture.

3 Claims, 2 Drawing Sheets

(56) References Cited

U.S. PATENT DOCUMENTS

| | | | | |
|---|---|---|---|---|
| 4,204,435 | A * | 5/1980 | Bridoux et al. | A61B 8/08 73/626 |
| 4,320,474 | A | 3/1982 | Huckabay et al. | |
| 4,888,746 | A * | 12/1989 | Wurster et al. | B06B 1/0625 367/138 |
| 4,922,594 | A * | 5/1990 | Patel et al. | G10K 11/32 181/175 |
| 9,301,044 | B2 * | 3/2016 | Takayasu | H04R 1/403 |
| 9,636,133 | B2 * | 5/2017 | Hall | H01L 41/053 |
| 9,936,969 | B2 * | 4/2018 | Vincenot | G10K 11/32 |
| 2004/0039312 | A1 | 2/2004 | Hillstead et al. | |

FOREIGN PATENT DOCUMENTS

| | | | |
|---|---|---|---|
| SU | 1379725 | A1 | 3/1988 |
| WO | 02/063606 | A1 | 8/2002 |

OTHER PUBLICATIONS

Klyukin, I. I., et al., Acoustic measurements in shipbuilding, 1966, pp. 5-14, L .: Sudostroenie.

Kolesnikov, A.E., Acoustic measurements, 1983, pp. 40-41, L .: Sudostroenie.

Ultrasound. Small Encyclopedia, edited by IP Golyamina, 1979. pp. 154-161, M .: Sov. Encyclopedia. 0.

Vasilovsky, V. V. et al., On the amplitude instability of the properties of piezoceramics in parametric hydroacoustic emitters.—Proceedings of the 2nd All-Union scientific and technical meeting "Nonlinear Sonar 76", Taganrog, TRTI, 1976, p. 82-85.

Novikov, B. K., et al, Non-Linear Hydro-Acoustics, 1981, pp. 154-156, L .: Sudostroenie.

Voronin V.A., et al., Hydroacoustic Parametric Systems, 2004, pp. 65-66, Rostov n/D, Rostizdat.

Voloshchenko, V.Yu., et al., Parametric sonar aids of the near underwater observation (part 1), 2009, pp. 182-183, Taganrog: Publishing house of TTI SFU.

Orlov, L.V., et al., Calculation and design of sonar fishing stations ,1974, pp. 97-98, M., Pishch. Prom.

Muir, T.J., Nonlinear acoustics and its role in the geophysics of marine sediments, Acoustics of marine sediments, transl. from English edited by Yu.Yu. Zhitkovsky, 1977, pp. 230-233, M.: Mir.

Timoshenko, V. I., Calculation and design of parametric acoustic transducers, Part 1, Tutorial, 1978, pp. 10-11, Taganrog, TRTI.

Novikov, B. K., et al., Parametric antennas in sonar, 1989, pp. 10-11, L.: Shipbuilding.

Evtyutov, A. P. et al., The Reference Book for Hydroacoustics, 1982, pp. 30-31, L.: Shipbuilding.

Rosenberg, L. F., Focusing ultrasound emitters, Sources of powerful ultrasound. Part 3.—1967, pp. 153-154, M.: "Nauka".

Special Workshop in Physics, Part 1, 3rd ed., 1977, pp. 309-317, M, Moscow University Press.

Ultrasound, Small Encyclopedia, edited by IP Golyamina, 1979, pp. 151-153, M.: Sov. Encyclopedia.

Hydroacoustic Encyclopedia, Ed. By V.I. Timoshenko, 1999.pp. 197-198, Taganrog: TRTU.

* cited by examiner

ELECTROACOUSTIC TRANSDUCER FOR THE PARAMETRIC GENERATION OF ULTRASOUND

RELATED APPLICATIONS

This Application is a Continuation application of International Application PCT/RU2018/000861, filed on Dec. 24, 2018, which in turn claims priority to Russian Patent Application RU2017146766, filed Dec. 28, 2017, both of which are incorporated herein by reference in their entirety.

FIELD OF THE INVENTION

The invention relates to the field of acoustic measurements, in particular to sound pressure measuring emitters, which are used as a source of sound vibrations in a hydroacoustic pool, and their spectral composition is determined by both their own resonant passband and the redistribution of powerful pump signals radiated, i.e. effects of both self-interaction and interaction arising from the propagation of acoustic waves of finite amplitude due to the nonlinearity of the elastic properties of aquatic environment.

BACKGROUND OF THE INVENTION

At present, in hydroacoustic measurements as measuring emitters of sound pressure, mainly cylindrical and disk weakly directional piezoelectric transducers are used, the use of compact devices that form sharply directed radiation in a measuring volume in wide band, parametric sound emitters, is promising. Sound pressure measuring emitters must meet special operational requirements: 1) high operational stability over time under various climatic conditions (atmospheric pressure, temperature, humidity);

2) a large dynamic range of amplitudes of the calibration sound pressure;

3) a wide range of operating frequencies; 4) characteristic of direction of the measuring emitter should contain a minimum number of additional lobs in the formed calibration acoustic field (see Klyukin I I, Kolesnikov A E Acoustic measurements in shipbuilding. —L.: Sudostroenie, 1966, p. 5-14).

Known cavitating pulsed parametric source used in hydroacoustic devices, which has a high spatial selectivity in the radiation mode on the low-frequency component of the spectrum generated in the aquatic environment—the difference frequency wave (U.S. Pat. No. 3,964,013 "Cavitating parametric underwater acoustic source", William L. Konrad, IntCl Ho4b 11/00, G01S 9/66, publ. Jun. 15, 1976), containing two generators of electrical oscillations with frequencies $f_1$, $f_2$, outputs of which are through a double balanced modulator, a pulse modulator controlled by a pulse generator, and a power amplifier is connected with piezoelectric transducer input equipped with shielding elements, hydro-, electric- and noise insulation.

The disadvantages of the analogue include low reliability and stability of piezoelectric transducer of a parametric source operation, besides, noise immunity of measurements carried out in a hydroacoustic basin is insufficient, which leads to incomplete compliance with operational requirements Below we consider in greater details some of the causes and consequences of the indicated non-compliance of the analog with operational requirements:

intense acoustic radiation—cavitation noise has a continuous spectrum in the band from several hundred hertz to thousands of kilohertz (see Kolesnikov A E Acoustic measurements. —L.: Sudostroenie, 1983, pp. 40-41), which creates a powerful masking interference. As a result, when conducting quantitative measurements, the signal-to-noise ratio at the receiver input decreases;

cavitation phenomena, generating strong hydrodynamic disturbances (see Ultrasound. Small Encyclopedia. Edited by IP Golyamin. —M.: Sov. Encyclopedia, 1979. P. 154-161), cause the destruction of the radiating surface of the piezoelectric device converter, reducing its effective life;

the reliability and stability of the operation of the piezoelectric transducer of a parametric emitter is reduced, since the piezoelectric material of the transducer, providing high efficiency of converting electric energy into acoustic energy, works under conditions of increased mechanical and electrical loads. So, for example, for parametric emitters of the NAI type in the normal mode, the specific acoustic power of collimated ultrasonic beams reaches $5\times10^4$ W/m$^2$, which corresponds to an electric field of the exciting signal on piezoceramics of ~$2.5\times10^4$V/m (see Vasilovsky V V, Lependin L F, Tarasova G B On the amplitude instability of the properties of piezoceramics in parametric hydroacoustic emitters. —Proceedings of the 2nd All-Union scientific and technical meeting "Nonlinear sonar 76. Taganrog, TRTI, 1976, p. 82-85), resulting in a shift of resonance frequency of the piezoelectric transducer and reduction in frequency range of the difference-frequency wave generating frequency band due to occurrence of nonlinear dependence of piezo-element deformation on the applied electric field thereto;

in the cavitating pulsed parametric source, there is no block of notch filters installed between the power amplifier and the piezoelectric transducer (see Novikov B. K., Rudenko O. V., Timoshenko V. I. Non-linear hydroacoustics—L.: Sudostroenie, 19811. —p. 154-156). Which leads to a "direct" radiation of the difference frequency signal generated in the electronic path of the device, distorting the characteristics of the working calibration acoustic field Features coinciding with the claimed object: two generators of electrical oscillations, a power amplifier, a piezoelectric transducer equipped with elements of shielding, hydro, electrical and noise insulation.

Acoustic parametric emitter is known, the radiation level of which is limited by saturation by pump (U.S. Pat. No. 4,320,474 "Saturation limited parametric sonar source", Huckabay et al, MKI H04b 1/02, publ. Mar. 16, 1982), containing a connected in series generator of biharmonic electric oscillations, a pulsed modulator controlled by a pulsed generator, and a power amplifier, from the output of which a powerful electrical signal is supplied to the inputs of two identical piezoelectric transducers with a flat disk piezoelectric element of radius (d/2) each, apertures of which are located M the same plane, and their phase-geometric centers offset by a distance 2d from each other and provided with screening elements, hydraulic, electrical and sound insulation.

The well-known acoustic parametric emitter also has insufficient compliance with operational requirements, in particular, the reliability and stability of the piezoelectric transducer of a parametric source is low, the generation of calibration sound vibrations of sound pressure in a small range of operating differential frequency signals is low $F=|f_2-f_1|$.

Below in greater details some of the causes and consequences of the indicated non-compliance of the analog with operational requirements are considered:

the generation efficiency of calibration sound vibrations is low due to the "transverse-spatial" separation of the centers of the apertures of two piezoelectric transducers with flat disk piezoelectric elements of radius (d/2) due to a decrease in both the region of "plane-wave" interaction of the pump signals and the amplitude of the sound pressure of the interacting spherical waves (see Voronin V. A., Tarasov S. P., Timoshenko V. I. Hydroacoustic parametric systems. —Rostov n/A: Rostizdat, 2004. p. 400);

the device does not provide the possibility of changing the relative position of two identical piezoelectric transducers with a flat disk piezoelectric element with a radius of (d/2) each, which does not allow to regulate the generation efficiency of calibration signals, the sound pressure levels of which are directly proportional to both the product of the amplitudes and the number of pump wavelengths that fall within the "common extent" of the region of mutual overlapping (see Voloshchenko V. Yu., Timoshenko V. I. Parametric sonar aids of the near underwater observation (part 1)—Taganrog; Publishing house of TTI SFU, 2009. p. 294);

the reliability and stability of the operation of the piezoelectric transducer of an acoustic parametric emitter is reduced, since the efficiency of converting electric energy into acoustic is limited by the fatigue-strength properties of piezoceramics (in analogue, the specific acoustic power of the signals of finite amplitude is (5-6) W/cm$^2$, which corresponds to the upper permissible boundary (see Orlov L. V., Shabrov A. A. Calculation and design of sonar fishing stations—M., Pishch. Prom., 1974), and the effect of saturation in the aquatic environment of powerful pump waves (see Muir T. J. Nonlinear acoustics and its role in the geophysics of marine sediments//Acoustics of marine sediments/ Transl. from English; Edited by Yu. Yu. Zhitkovsky. —M.: Mir, 1977. —p. 227-273).

Features coinciding with the claimed object: an electric oscillation generator, a power amplifier, a piezoelectric transducer equipped with elements of shielding, hydro, electrical and noise insulation.

Known adopted as a prototype parametric measuring emitter for hydroacoustic pools (see Timoshenko V I. Calculation and design of parametric acoustic transducers. Part 1. Tutorial. —Taganrog, TRTI, 1978, p. 91), containing two generators of electrical oscillations, the outputs of which through a linear adder, a pulse modulator controlled by a pulse generator, as well as a power amplifier and a notch filter connected to the piezoelectric transducer input equipped with shielding elements, hydro-, electrical and sound insulation, the emitting aperture of the latter is a convex spherical surface.

The disadvantage of the measuring emitter according to the prototype is the lack of compliance with operational requirements, in particular, the range of operating frequencies of calibration signals in the low-frequency region is limited, the conversion coefficient of the generated signal of the difference signal from ultrasonic pump signals is reduced, the specific acoustic power of the pump signals is not provided in the aquatic environment, etc.

Below, in greater details some of the reasons and consequences of the specified mismatch of the prototype with operational requirements are considered:

low generation efficiency of calibration sound vibrations due to the use of a piezoelectric transducer, the radiating aperture of which is a portion of a convex spherical surface. Thus, in the description of the prototype (see Timoshenko V. I. Calculation and design of parametric acoustic transducers. Part 1. Textbook. —Taganrog, TRTI, 1978, 91 pp.) results of theoretical and experimental studies are presented, and also tests of various designs of parametric sonar transducers both with a flat one (diameter 15 mm, resonant frequency $f_0$=1.98 MHz, the length of the saturation region ~0.3 m; spherical distribution ~1.5 m), and convex (diameter 20 mm, radius of curvature 23, 7 mm, the resonance frequency $f_0$=2.03 MHz, length of a saturation region ~0.04 m, spherical spreading ~0.5 m) radiating apertures, in particular, graphics axial distributions of the amplitudes of the sound pressure wave at the difference frequency F=100 kHz. From a comparison of the graphs it follows that at the same amplitudes of the pump signals (the sound pressure level of the pump waves is 78 dB relative to 1 Pa at a distance of 1 m) due to their different collimation (angular widths at a level of 0.7~6° and 15°, respectively) relative to the acoustic axes in the range (0.5 m-3 m) of the sound pressure amplitude for the difference frequency wave (F=100 kHz) generated in the aquatic environment for a flat aperture exceed by 8 dB (~2.5 times) the values of a similar value for a convex aperture;

the specific acoustic power necessary for the full manifestation of the nonlinearity of its elastic properties due to the use of the radiating aperture of the piezoelectric transducer in the form of a portion of a convex spherical surface and, accordingly, the divergence of the wavefront is not provided in the aquatic environment (see Novikov B. K., Timoshenko V. I. Parametric antennas in sonar. —L.: Shipbuilding, 1989.-256 p.);

energy potential is limited, characterized by the acoustic power of its radiation per unit area of a convex spherical aperture. Thus, to increase this operational ability of the prototype due to the increase in the emitted acoustic energy of the ultrasonic pump signal, it is necessary to increase the area of the piezoelectric transducer (see the Reference book for hydroacoustics/A. P. Evtyutov, A. P. Lyalikov, V. B. Mitko, V. I. Ponomarenko, A. L. Prostakov, G. M. Sverdlin, M. D. Smaryshev, Yu. F. Tarasyuk, A. E. Kolesnikov—L.: Shipbuilding, 1982.-344 p.), I.e. an increase in its geometric dimensions, which in turn will lead to a decrease in the length of the working area of the spherical distribution of the formed calibration signals;

conversion coefficient of the generated signal of differential signal, (see Hydroacoustic Encyclopedia./Ed. by V. I. Timoshenko. —1st ed. —Taganrog: TRTU, 1999.-788 p.) coming from ultrasonic pump signals due to the use of a radiating aperture a piezoelectric transducer in the form of a portion of a convex spherical surface, is reduced;

the range of operating frequencies of calibration signals is limited to the low-frequency region, since only the spectral components of the difference frequency are used, while high-frequency spectral components—acoustic signals of multiple frequencies (harmonics)—are also formed in a nonlinear aquatic environment (see Voloshchenko B. Yu., Timoshenko V. I. Parametric sonar aids for near underwater observation (part 1)—Taganrog: Publishing House of TTI SPU. 2009.-294 p.).

Features coinciding with claimed object: two generators of electrical oscillations, a linear adder, a pulse modulator, a pulse generator, a power amplifier, a notch filter, a piezoelectric transducer equipped with elements of shielding, hydro, electrical and noise insulation, the radiating aperture of which is a section of a convex spherical surface.

Thus, the general disadvantages of the prototype and the above analogues include insufficient compliance with operational requirements, in particular, a reduced conversion coefficient of the generated differential signal from ultrasonic pump signals, a limited range of operating frequencies of calibration signals to the low-frequency region, since only the spectral components of the differential frequency are used, insufficient energy potential, characterized by the acoustic power of its radiation per unit the area of the convex spherical aperture, the reliability and stability of the piezoelectric transducer are low.

SUMMARY OF THE INVENTION

The task of the invention is to expand the operational capabilities of the device, which consists in the ability to generate calibration sound waves in a nonlinear aquatic environment in a wide range of changes in the working amplitudes of its sound pressure at a low level of acoustic noise in a hydro-acoustic measuring pool.

The technical result of the invention is provided by increasing the sound pressure amplitude level of the components of the polyharmonic signal of the resulting calibration ultrasonic field in the hydroacoustic pool, which allows to increase measurements validity and to decrease difficulties of getting these results due to the reducing of masking noise level.

The technical result of the invention is provided by increasing the sound pressure amplitude level of the components of the polyharmonic signal of the resulting calibration ultrasonic field due to the phased addition in the given area of the nonlinear aquatic environment of the acoustic power of the two-frequency pump signals, emitted by piezoelectric transducers with both convex and concave spherical surfaces of the apertures, using the supporting structure providing alignment in space of the acoustic axes of the piezoelectric transducers, and, accordingly, the passage of pump waves from the second transducer, aperture of which is concave, through the through hole in the central part of the first transducer with a convex aperture, moreover, the distance on the common acoustic axis between the phase-geometric centers of the spherical apertures of the piezoelectric transducers is set equal to the focal, as a result, the focal region from the second transducer is located in the through hole of the Central part of the first transducer.

The technical result is achieved by the fact that in the known parametric measuring emitter for hydroacoustic pools, containing two generators of electrical oscillations, the outputs of which are through a linear adder, a pulse modulator controlled by a pulse generator, as well as a power amplifier and a notch filter, the output of which is connected to the input of the piezoelectric transducer with a convex spherical surface of the aperture, put additionally connected with a notch filter output a second piezoelectric transducer with a concave spherical surface of aperture and a cylindrical supporting structure combining the first and second piezoelectric transducers, configured to provide a centered change in the distance between them, moreover, for both piezoelectric transducers, the diameters D of the apertures, the average wavelength $\lambda$ for the range of emitted pump signals, radii of curvature $R_0$, focal lengths $F_0$, focal spots radii $r_0$ are the same and are related by $r_{0x}R_0=0.61\times\lambda\times F_0$, the first piezoelectric converter formed with an open axial hole with radius $r=(2\div3)\times r_0$ in the central part of the convex spherical surface of the aperture, the second piezoelectric input with concave spherical surface aperture is connected with the notch filter output.

These mentioned differences ensure the phasing of acoustic pump wave beams of the first and second piezoelectric transducers during their propagation in aquatic environment in the areas of both saturation and spherical propagation of the formed calibration signals.

It is rational in electro-acoustic transducer for parametric generation of ultrasound to carry out the cylindrical supporting structure mainly with the possibility of providing a change in the distance between the first and second piezoelectric transducers.

In electro-acoustic transducer for parametric generation of ultrasound, the first and second piezoelectric transducers are equipped with shielding elements of hydro-, electro- and noise insulation.

Distinctive essential features, together with the described connections, expand both operational requirements and the possibility of using an electro-acoustic transducer for parametric generation of ultrasound, which consists in increasing the sound pressure amplitude of formed in nonlinear aquatic environment acoustic signals of operating frequencies, which are used as calibration signals during hydroacoustic measurements.

BRIEF DESCRIPTION OF THE DRAWINGS

The invention is illustrated by drawings, with

DETAILED DESCRIPTION OF THE PREFERRED EMBODIMENTS

Figure 1:
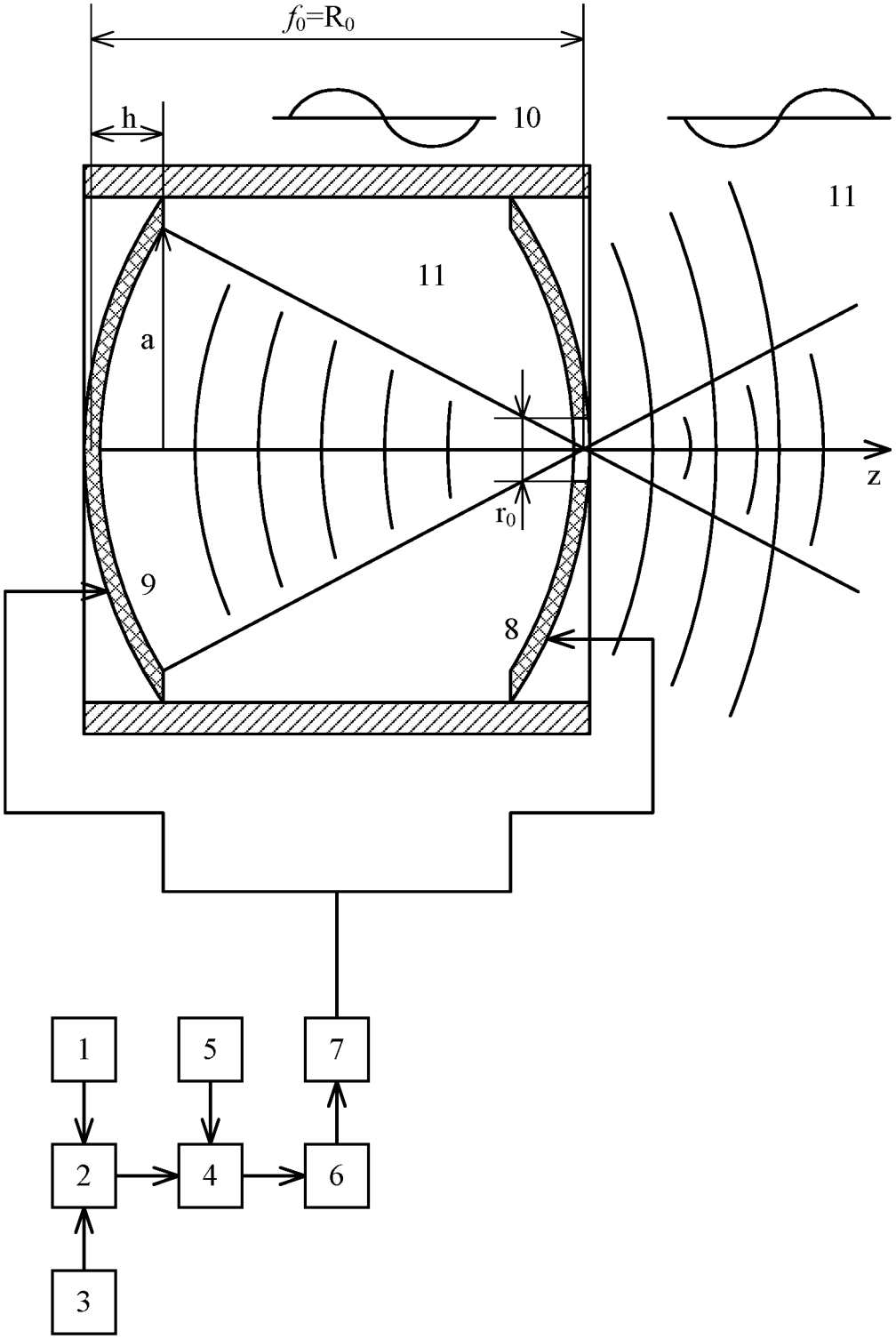
FIG. 1 showing a block diagram of an electro-acoustic transducer for parametric generation of ultrasound.

The electro-acoustic transducer for parametric generation of ultrasound contains (FIG. 1) the first 1 and second 3 electric oscillation generators, the outputs of which are through a linear adder 2, a pulse modulator 4, controlled by a pulse generator 5, as well as a power amplifier 6 and a notch filter 7 are connected to the inputs of the first a piezoelectric transducer 8 with a convex spherical surface of the aperture and a second piezoelectric transducer 9 with a concave spherical surface of the aperture, and the supporting structure of the cylinder 10, which combines piezoelectric transducers 8 and 9. The supporting structure 10 provides the possibility of a centered change in the distance between the piezoelectric transducers 8 and 9, moreover, for both piezoelectric transducers, the diameters D of apertures, the average wavelength $\lambda$ for the range of emitted pump signals, the curvature radii $R_0$, focal lengths $F_0$, focal spot radii $r_0$ are the same and are related by the relation $r_{ox}R_0=0.61\times\lambda\times F_0$ (see Rosenberg L. F. Focusing ultrasound emitters. In the book: Sources of powerful ultrasound. Part 3. M Nauka, 1967. —321 s), and the first piezoelectric transducer 8 with a convex spherical surface of the aperture is made with open axial hole with a radius of $r=(2\div3)\times r_0$ in its central part. The input of the second piezoelectric transducer 9 with a concave spherical surface of the aperture is connected to the output of the notch filter 7. For phasing both acoustic beams of powerful pump waves propagating in aquatic environment both in the saturation region (near zone, stabilization distance) and in the working region of spherical propagation formed calibration signals, the supporting structure of the cylindrical shape 10 provides the ability to change the distance between the first 8 and second 9 piezoelectric transducers (the principle of constructing load-bearing structures providing alignment of the acoustic system, and methods for precision changing the distance between transducers are known and are used in methods of ultrasonic interferometry (see Special Physical Workshop, Part 1 3rd ed., M, Moscow University Press—ta, 1977, pp. 309-317, Ultrasound, Small Encyclopedia, Editor-in-Chief of IP Golyamin, Moscow: Sov. Encyclopedia, 1979. P. 151-153), the latter being equipped with elements of shielding, hydro, electrical and noise insulation.

The claimed invention allows to expand the functionality of an electro-acoustic transducer for parametric generation of ultrasound, which consists in increasing the amplitude of the sound pressure generated in a nonlinear aqueous medium of acoustic signals of operating frequencies used as calibration signals during hydroacoustic measurements. This increases the reliability of the measurement results and reduces the complexity of obtaining them by reducing the level of masking noise with increasing amplitudes of sound pressure formed in a nonlinear aqueous medium of calibration signals.

Electro-acoustic transducer for parametric generation of ultrasound (FIG. 1) works as follows. Generators 1, 3 generate electrical signals with frequencies $f_1$, $f_2$, coming through a linear adder 2 to the input of a pulse modulator 4, controlled by a pulse generator 5. From the output of the pulse modulator 4, a radio pulse with biharmonic filling (beat of electrical vibrations of close frequencies $f_1$, $f_2$, located in the passband of piezoelectric transducers 8, 9 with convex and concave spherical surfaces of the apertures), through a power amplifier 6 and a notch filter 7 is fed to the inputs of piezoelectric transducers 8, 9 with both convex and concave spherical surfaces of apertures equipped with elements of shielding, hydro, electrical and noise insulation. The half-wave piezoceramic active elements—the apertures of the piezoelectric transducers 8, 9 are sections of a convex (concave) spherical surface that form in the aquatic environment 11 a directivity characteristic for acoustic pump waves having circular symmetry about an axis passing through its center and perpendicular to the middle of the convex (concave)) surface. Due to the piezoelectric properties, the piezoceramic apertures of the piezoelectric transducers 8, 9 will change their half-wave thicknesses with frequencies equal to the frequencies of the applied voltage, i.e. will oscillate. All points of the surfaces oscillate in phase and with the same amplitude. These vibrations are transmitted to the aqueous medium 11 and propagate in the form of condensations and discharges, and, in some directions, the resulting amplitude of coherent oscillations with the frequencies of the pump signals increases (the oscillation phases coincide), in others, they weaken to one degree or another (the oscillation phases do not coincide). These disturbances create a distribution of the sound pressure level of powerful pump signals in space, having circular symmetry about an axis passing through the center and perpendicular to the middle of the convex (concave) surfaces and determined by the direction to the observation point from the location of the transducer, which is called its directivity characteristic. The relative position of piezoelectric transducers 8, 9 with convex and concave spherical surfaces of the apertures is fixed by a cylindrical supporting structure 10, and it is thus chosen that the electro-acoustic transducer 8 with a convex aperture is located on the acoustic axis of the electro-acoustic transducer 9 with a concave aperture at a focal distance $F_0$ from it, wherein, the focal spot is located in the through hole of radius $r=(2\times3)\times r_0$ in the central portion of the electroacoustic transducer 8 with convex spherical surface aperture. With this arrangement, the predominant part of the focused emitted acoustic energy of the pump waves passes through the main diffraction maximum of the focal spot with a radius $r_0$, as a result of which the piezoelectric transducer 8 with a convex spherical aperture surface located in the focal plane has practically no effect on the radiation mode and parameters of the piezoelectric transducer 8 with convex aperture.

A converging acoustic wave from a piezoelectric transducer 9 with a concave spherical surface of the aperture is transformed in focus into a diverging spherical wave, the phase of which differs from the phase of the initial wave by $\pi$ (see Rosenberg L F Focusing ultrasound emitters. In the book: Sources of powerful ultrasound. Part 3. —M.: Nauka, 1967. —321 p.). Therefore, the wave front after focusing coincides with the wave front emitted by the piezoelectric transducer 8 with a convex spherical surface of the aperture, and when the initial phases of the oscillations coincide, the acoustic vibrations of both diverging spherical waves are added, which in turn leads to an increase in the sound pressure amplitude level of the difference signal, used for graduation in the aquatic environment 11.

The aquatic environment 11 has a nonlinearity of its elastic properties, which leads to the appearance of nonlinear effects of both self-interaction and interaction during the propagation of an intense ultrasonic wave pulse (see Muir T. J. Nonlinear acoustics and its role in the geophysics of marine sediments//Acoustics of marine sediments/Translated from English; Edited by Yu. Yu. Zhitkovsky. —M.: Mir, 1977. p. 227-273). These effects can be considered as the result of the nonlinear change in the elastic properties of water 11 on the characteristics of a powerful pulse pump signal in the propagation region, as a result of which, in particular, the pump signals interact with frequencies ЧасТОТ $f_1$, $f_2$, the result of which is the parametric generation of calibration ultrasonic signals as a difference $F=|f_2-f_1|$, and the total $f_+=f_2+f_1$ frequencies, second harmonics $2f_1$,$2f_2$ of pump waves.

The claimed construction that implements a method of adding acoustic power while maintaining the initial characteristics of electro-acoustic transducers 8, 9 with convex and concave spherical surfaces of the apertures has peculiarities. Since in this case we use two electro-acoustic transducers 8, 9 of sufficient wave sizes $D/\lambda>10$, where D is the diameter of the aperture, $\lambda$ is the wavelength of the emitted pump signal, when choosing a specific distance between them, the beat of two frequencies should be used as the pump signal and phasing the pump signals mechanically, the result of which is fixed by the supporting structure 10. Operation in the pulsed mode with this method of adding acoustic signals of difference frequency imposes a condition on the value of the duration of the emitted pulse $\tau_u=F_0/c$, where c is the speed of sound.

The stated principle of constructing an electro-acoustic transducer for parametric generation of ultrasound was implemented in the design of a pump transducer for the non-linear acoustic emitter NAI-9 (resonant frequency $f_0$=1380 kHz, focal length $F_0$=47 mm, segment diameter 2a=47 mm, emitter depth h=6 mm), experimental results were obtained for both low- and high-frequency components of the spectrum.

Figure 2:
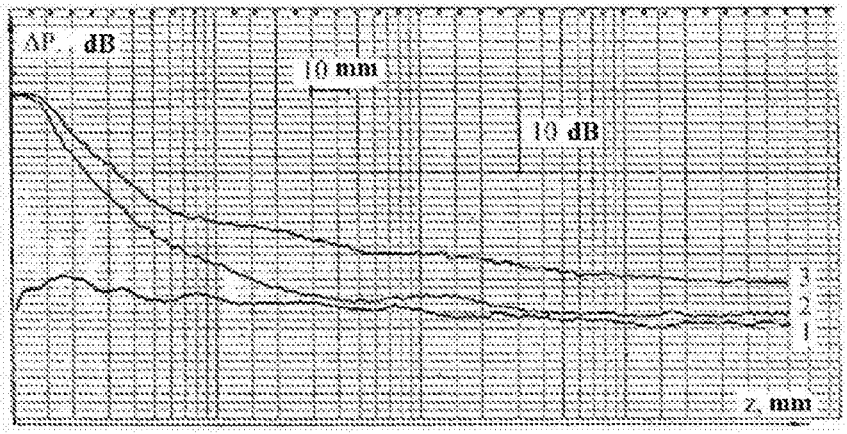
FIG. 2. showing distribution of sound pressure amplitudes for a difference frequency signal F=25 kHz on the acoustic axis of an electro-acoustic transducer for parametric generation of ultrasound.

FIG. 2 shows the distribution of amplitudes of sound pressure for a difference frequency signal F=25 kHz on the acoustic axis of an electro-acoustic transducer for parametric generation of ultrasound:

1) it emits only the first piezoelectric transducer 8 with a convex spherical surface of the aperture;

2) emits only the second piezoelectric transducer 9 with a concave spherical surface of the aperture;

3) both the first and second piezoelectric transducers 8, 9 are emitted with convex and concave spherical surfaces of the apertures, which in the far zone leads to an increase in the amplitude of the sound calibration signal by (4-5) dB.

Figure 3:
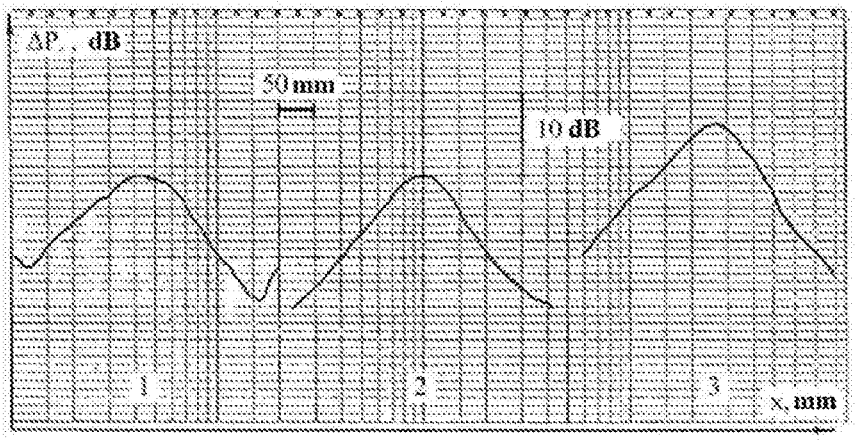
FIG. 3. showing transverse distribution of sound pressure amplitudes for a difference frequency signal F=50 kHz of an electro-acoustic transducer for parametric generation of ultrasound.

FIG. 3 shows the experimental transverse distribution of the amplitudes of sound pressure for a difference frequency signal F=50 kHz of the clamed electro-acoustic transducer for parametric generation of ultrasound, where:

1) emits only the first piezoelectric transducer 8 with a convex spherical surface of the aperture;

2) emits only the second piezoelectric transducer 9 with a concave spherical surface of the aperture 3) jointly emit both the first and second piezoelectric transducers 8, 9 with convex and concave spherical surfaces of the apertures. From a comparison of the curves (FIG. 3), it follows that the third option in the far zone leads to an increase in the amplitude of the sound calibration signal by 6 dB.

Analysis of the above experimental results allows us to draw the following conclusions—the inventive electro-acoustic transducer for parametric generation of ultrasound satisfies at least the following special operational requirements:—a large dynamic range of amplitudes of calibration sound pressure; —a wide range of operating frequencies; the directivity characteristic of the measuring emitter contains the minimum number of additional petals in the formed calibration acoustic field. It should be noted that both the axial and transverse distributions of the amplitudes of sound pressure (FIGS. 2, 3) for the acoustic fields of difference-frequency signals generated by an electro-acoustic transducer for parametric generation of ultrasound are in compliance with another operational requirement for the formed calibration field:—monotonies and the uniformity of changes in the amplitudes of sound pressure both in the longitudinal and transverse directions of the water volume of the hydroacoustic pool, which allows to place calibration receivers close enough to the device. Based on this, it can be assumed that the practical use of the proposed electro-acoustic transducer for parametric generation of ultrasound as a measuring one in the conditions of hydro-acoustic pools of limited sizes, in addition to the above advantages, will make it possible to reduce the weight and dimensional parameters of the hydro-acoustic pools.

It must be emphasized that an increase in the amplitude of sound pressure of the components of the calibration signal of the resulting ultrasonic field in the measuring volume of the sonar pool leads to an increase in the reliability of the measurement results. It should be noted that in acoustic measurements, in addition to the useful signal, the receiving channel is affected by signals that make it difficult to take measurements, since they distort or mask the useful signal. Thus, as a rule, in acoustic measurements, the signal level (measured with disturbance interference) should be (10-15) dB higher than the noise level (measured with no signal), and it is most difficult to eliminate the reverberation noise, i.e. noise generated by a scattered useful signal. However, the inventive electro-acoustic transducer for parametric generation even in this case benefits due to the increasing of the directivity and the absence of side radiation.

Claimed invention can find wide application in the field of acoustic measurements, in particular in measuring sound pressure emitters, which in a hydro-acoustic pool can be used as a source of sound vibrations with a high amplitude of sound pressure, which improves the reliability of the measurement results and reduces the difficulty of obtaining them for by reducing masking noise.

What is claimed is:

1. An electro-acoustic transducer for parametric generation of ultrasound comprising:

two generators of electrical oscillations, the two generators having their outputs connected via a linear adder to an input of a pulse modulator;

the pulse modulator controlled by a pulse generator;

a power amplifier; and a notch filter having an output connected to an input of a first piezoelectric transducer, the first piezoelectric transducer having a radiating aperture which is a section of a convex spherical surface;

a second piezoelectric transducer with a concave spherical aperture surface, the second piezoelectric transducer being connected to the output of the notch filter; and a supporting structure of a cylindrical shape supporting the first and the second piezoelectric transducers, wherein for both of the piezoelectric transducers a diameter D of the apertures, an average wavelength $\lambda$ for a range of pump signals emitted by the piezoelectric transducers, radii of curvature $R_0$, focal lengths $F_0$, radii $r_0$ of focal spots are chosen identical and are related as $r_0 \times R_0 = 0.61 \times \lambda \times F_0$, and wherein the first piezoelectric transducer is provided with an open axial hole radius $r=(2 \div 3) \times r_0$ in a central portion of the convex spherical surface of the radiating aperture.

2. The electro-acoustic transducer for parametric generation of ultrasound according to claim 1, the supporting structure of the cylindrical shape is configured to provide a change in a distance between the first and the second piezoelectric transducers.

3. The electro-acoustic transducer for parametric generation of ultrasound according to claim 1, wherein the first and the second piezoelectric transducers are equipped with shielding elements, hydro-, electro- and noise insulation.

* * * * *